United States Patent [19]

Laska

[11] Patent Number: 4,580,324

[45] Date of Patent: Apr. 8, 1986

[54] METHOD FOR ROUNDING FLAT-OVAL TUBING

[75] Inventor: Stanley T. Laska, Jacksonville, Tex.

[73] Assignee: Wynn-Kiki, Inc., Crowley, Tex.

[21] Appl. No.: 623,379

[22] Filed: Jun. 22, 1984

[51] Int. Cl.[4] ..... B21D 53/06

[52] U.S. Cl. ..... 29/157.4; 29/157 T; 30/305; 72/325

[58] Field of Search ..... 72/367, 370, 325; 29/157.3 R, 157.3 C, 157.4, 157 T, 157 R, 156.8 H, 156.8 T, 156.8 R; 30/304, 305

[56] References Cited

U.S. PATENT DOCUMENTS

| | | | |
|---|---|---|---|
| 637,463 | 11/1899 | Hegarty | 30/304 X |
| 1,685,678 | 9/1928 | Mirfield | 72/325 |
| 2,535,470 | 12/1950 | Welshman | 72/370 X |
| 3,173,196 | 3/1965 | Grimm . | |
| 3,177,694 | 4/1965 | Bialas . | |
| 3,662,582 | 5/1972 | French . | |
| 3,731,517 | 5/1973 | Johnson . | |

*Primary Examiner*—Carl E. Hall

*Attorney, Agent, or Firm*—James E. Bradley

[57] ABSTRACT

A method for rounding a fixture receiving end of flat-oval tubing having internal transverse webs is disclosed. The webs are severed and the ends of the web severance are then reformed to reduce stress concentration in preparation for further working. The end of the tubing is then belled out to a cylindrical shape where the webs have been severed by inserting a male arbor which causes the inner diameter of the tubing to conform to its round cross-section. It is preferred that the arbor be grooved to accept registration with the severed webs. The outside diameter of the fixture end of the tubing is reduced by swagging with a mandrel to the extent necessary to form a standard size for which equipment is readily available. This method provides flat-oval tubing with ends that easily accept valves, fittings, and other connections as needed.

7 Claims, 8 Drawing Figures

METHOD FOR ROUNDING FLAT-OVAL TUBING

BACKGROUND OF THE INVENTION

A common means of exchanging heat energy between two fluids is to drive the first fluid through a highly thermally conductive pipe or tube and to flow the second fluid across the outside of the tube. Specific applications include industrial and automotive heating and cooling equipment such as air conditioners.

Flat-oval tubing has proved a very effective thermally conductive pipe for carrying the first fluid in such applications. The surface with which a specific volume of fluid thermally interacts while flowing through a pipe or tubing is increased by using flattened tubing rather than round tubing and further increased by placing transverse webs of a highly thermally conductive material across the tubing.

Aluminum is used extensively in such applications because of its relative cost, its high thermal conductivity and the ease with which aluminum tubing is fabricated. The ductile nature of this metal is further an important attribute in many applications in that it permits easy construction with prefabricated tubing that it is easily bent and retains the desired shape once bent.

The method of the present invention relates to a method for reforming a fixture receiving end of flat-oval tubing of the kind described above which is divided by transverse webs into separate chambered conduits that extend the length of the tubing.

However, flat-oval tubing which is desirable for the heat transfer characteristics is difficult to work with because standard fixtures and equipment that are readily available on the market fit only round tubing. Placement of valves and connections both entering and leaving the heat exchange tubing is awkward and is severely limited by the commercially available options. Adapters which fit at one end onto the flat-oval tubing and present a standard round configuration on the other end are difficult to seal about the tubing and adversely affect the flow within the tubing.

It is an object of the present invention to provide an efficient method for reforming a fixture receiving end of flat-oval tubing into a round configuration to provide for secure, sealed interface with the readily available standard fixtures designed for round pipe. It is another object of the present invention to minimize stress concentration and maximize fluid flow characeristics for heat transfer in the transition from round conduit to the flat, oval heat exchanging tubing having integral transverse webs.

SUMMARY OF THE INVENTION

The present invention is a method of rounding a fixture receiving end of flat-oval tubing of aluminum or other ductile material in which heat conductive webs crossing the interior of the tubing are severed and the ends of the web severance are then reformed to reduce stress concentration in preparation for further working of the fixture receiving end. The fixture end of the tubing is then belled out to a cylindrical shape where the webs have been severed by inserting a male arbor which causes the inner diameter of the tubing to conform to its round cross section. It is preferred that the arbor be grooved to accept registration with the severed webs.

The outside diameter of the fixture end of the tubing is reduced by swaging with a mandrel to the extent necessary to from a standard size for which equipment is readily available. It is preferred that reinforcement be provided to the flat-oval tubing to limit the region which is reformed to a round shape and thereby protect the integrity of the flat-oval tubing that is not immediately at the fixture receiving end.

DETAILED DESCRIPTION OF THE DRAWINGS

Figure 1:
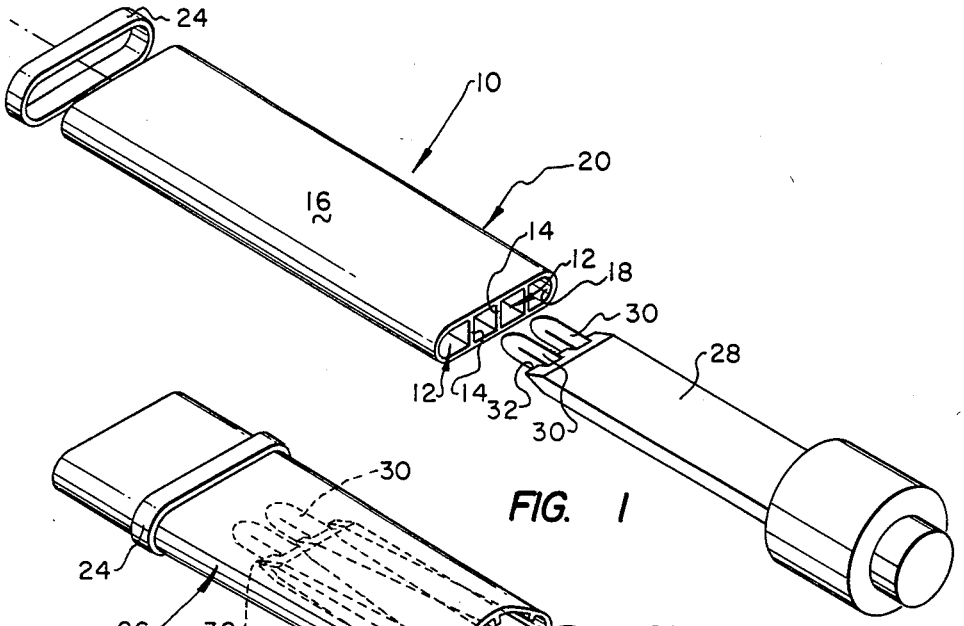
FIG. 1 is a perspective view of flat-oval tubing, a reinforcing collar prior to setting on a flat-oval tube, and a chisel knife tool prior to registration with the flat-oval tube.

FIG. 1 is a perspective view of flat-oval tubing 10 having an exterior wall 16 and an interior wall 18 and which is divided into conduits 12 by webs or ribs 14 connecting the interior walls.

The flat-oval tubing is formed of a highly conductive material which will transfer heat quickly from exterior 16 to interior 18 and to webs 14. Fluid running through conduits 12 rapidly transfers heat with the exterior of the flat-oval tubing 10 because interior surface area of highly thermal conductive tubing is maximized with respect to the volumetric flow through the tubing.

Figure 2:
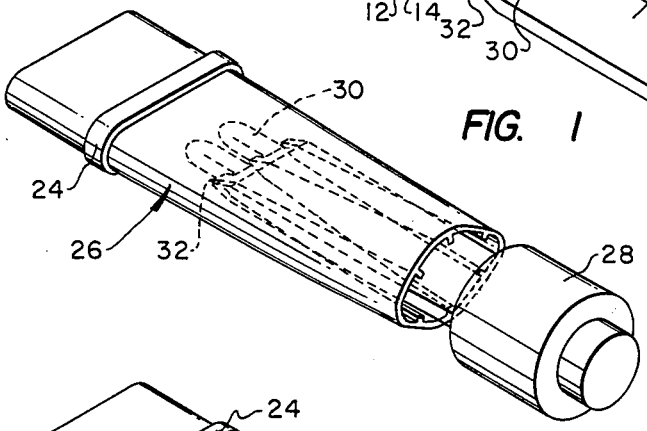
FIG. 2 is a perspective view of a chisel knife tool cutting the transverse webs of the flat-oval tubing.

The reworking of fixture receiving end 20 of flat-oval tubing 10 is localized by reinforcing tubing 10 with a reinforcing collar 24. In FIG. 2, reinforcing collar 24 has been set about the tubing adjacent a desired transition region 26 where the area of the tubing is to be reworked into a cylindrical shape joins the unaltered flat-oval tubing.

Returning to FIG. 1, the preferred embodiment of chisel knife tool 28 presents pilots 30 which engage chambered conduits 12 and aligns cutting edge 32 with the midpoint of webs 14.

Internal features of flat oval tubing 10 and the position of chisel knife 28 have been shown in dotted outline in FIG. 2 in which cutting edge 32 has severed ribs 14 as chisel knife tool 28 was advanced into the fixture receiving end of flat-oval tubing 10.

The registration of pilots 30 with chambered conduits 12, insures that webs 14 are severed along their midpoint so far as the depth of transition region 26.

Figure 3:
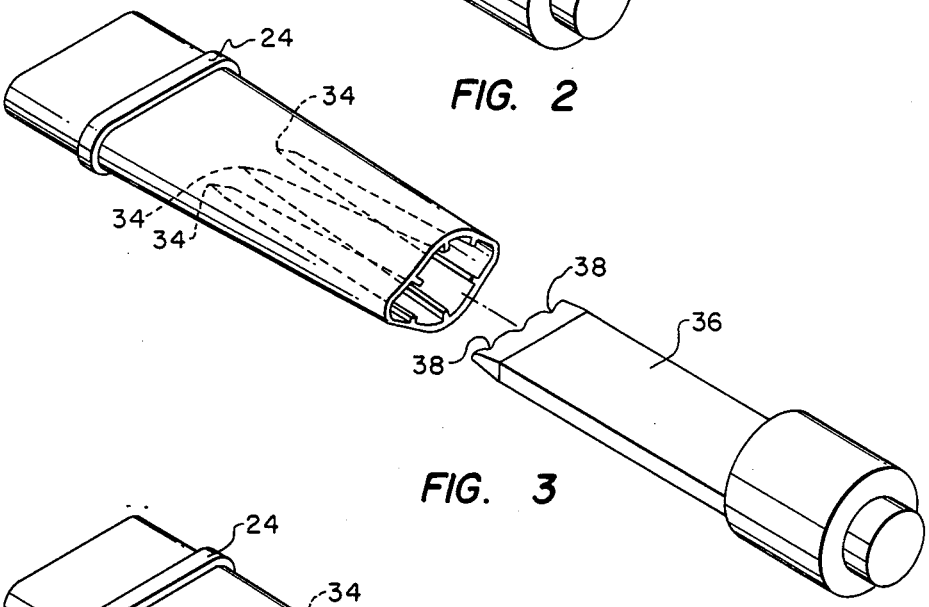
FIG. 3 is a perspective view of a flat-oval tubing and an end forming blade tool.
Figure 4:
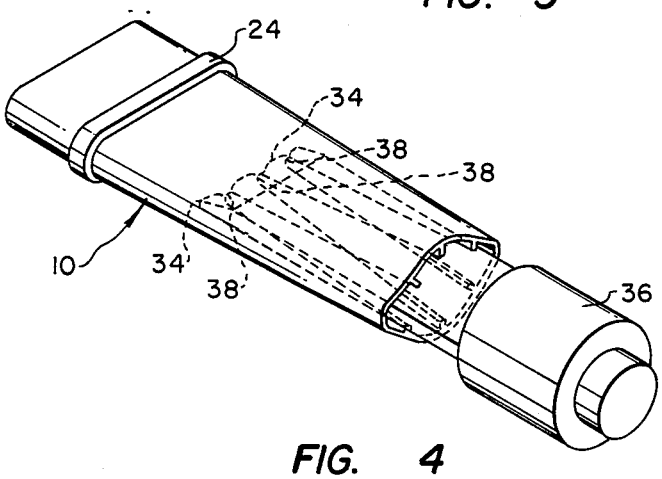
FIG. 4 is a perspective view of an end forming blade tool reforming the webs in the tubing.

Cutting edge 32 leaves a wedge shape cut at the point of separation 34 in each of webs 14. The cuts are shown in dotted outline in FIG. 3. In the preferred embodiment, points of separation 34 in the respective webs are in alignment perpendicular to the axis of the tubing. End forming blade tool 36, illustrated in FIG. 3, has curved working surfaces 38. In FIG. 4, end forming blade tool 36 has been inserted such that curved working surfaces 38 have reformed the sharp angular surfaces of webs 14 at point of separation 34.

The webs are reformed at point of separation 34 to full radius cuts in the preferred embodiment, thereby minimizing the stress concentration present when the fixture receiving end of tubing 10 is spread more open.

Figure 5:
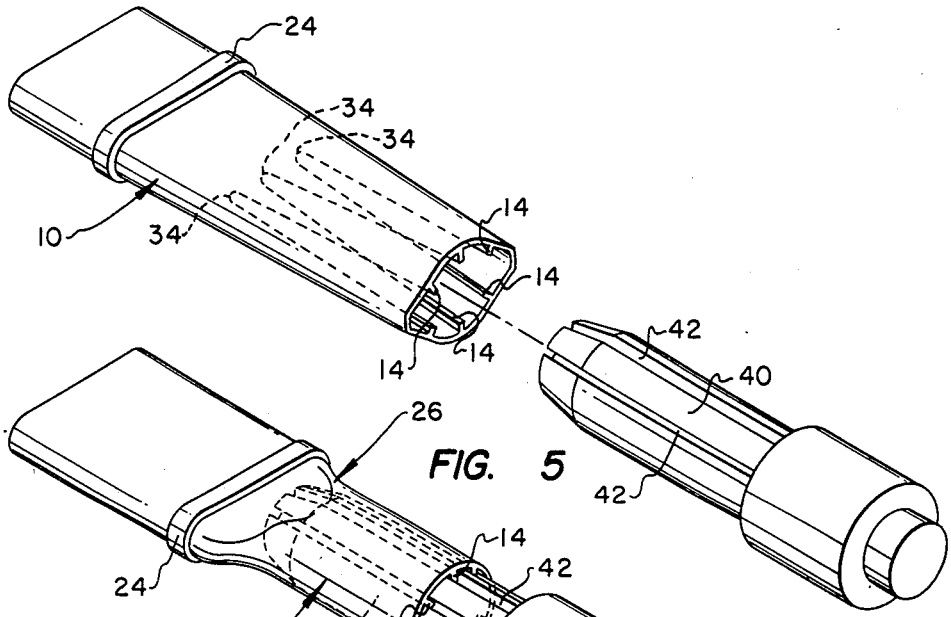
FIG. 5 is a perspective view of the tubing and a male arbor.

In FIG. 5, the points of separation for webs 14 have been reformed and a male arbor 40 is aligned such that grooves 42 register with the severed ends of webs 14 as male arbor 40 is inserted into the fixture receiving end 20 of tubing 10.

Figure 6:
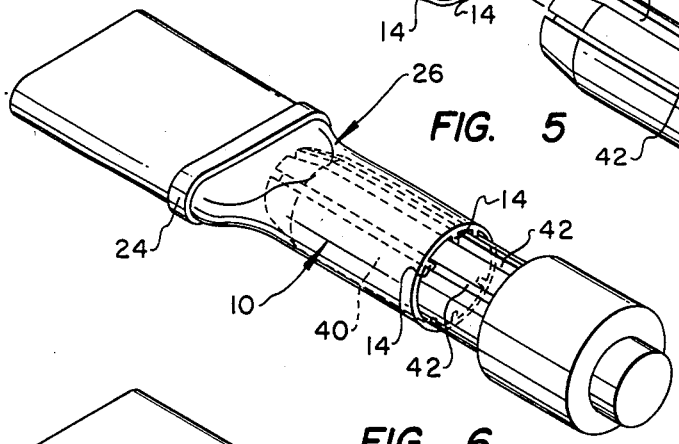
FIG. 6 is a perspective view of a male arbor belling out the fixture receiving end of the tubing.

In FIG. 6, male arbor 40 has been inserted into oval tubing 10, belling out oval tubing 10 by forcing the inner surfaces of tubing 10 to conform to the exterior surface of male arbor 40.

Figure 7:
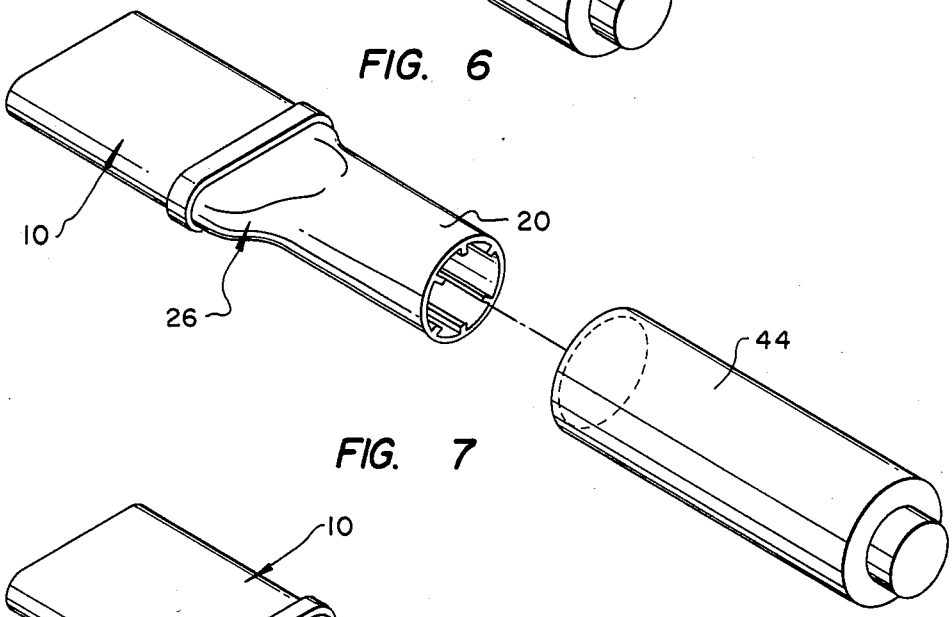
FIG. 7 is a perspective view of the tubing and a reducing mandrel.
Figure 8:
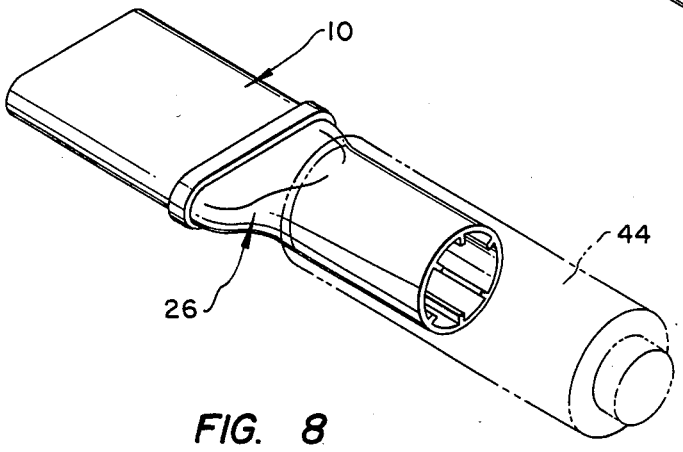
FIG. 8 is a perspective view of a reducing mandrel swaging the fixture receiving end of the tubing.

FIG. 7 illustrates fixture receiving end 20 of tubing 10 after male arbor 40 has been removed and shows the approach of reducing mandrel 44 and in FIG. 8, the reducing mandrel has been inserted over the now round porion of oval tubing 10 to swage the cylindrical portion of tubing 10, thereby reducing its outside diameter to a standard pipe fitting size. Depending on the reducing desired, it may be necessary to repeat this swaging steps with successively smaller mandrels 44.

Although the invention has been described and illustrated with a certain degree of particularity, it is understood that the present disclosure has been made by way of example only. Numeous changes in the detail of the method may be resorted to without departing from the spirit and scope of the invention as hereinafter claimed.

I claim:

1. A method of rounding an end of oval tubing which has transverse webs dividing the interior thereof into separate chambered conduits which extend the length of the tubing, said method comprising:

longitudinally cutting the webs in the end of the tubing to a desired transition region;

reforming the webs at the end of the longitudinal cut into a curved surface; and belling out the end of the tubing to form a substantially cylindrical rounded end.

2. A method of rounding oval tubing in accordance with claim 1, wherein the step of cutting the webs comprises:

registering at least one pilot protruding from a transverse cutting edge of a chisel knife tool into at least one of the chambered conduits at the end of the tubing; and advancing the cutting edge of the chisel knife tool into the end of tubing until the cutting edge reaches the desired transition region, thereby severing the webs to the transition region.

3. A method of rounding oval tubing in accordance with claim 1, wherein the step of belling out the end of the tubing comprises:

registering peripheral grooves in a male arbor with the severed webs presented in the end of the tubing; and inserting the registered male arbor into the end of the tubing, causing the inner diameter to take on the shape of the male arbor.

4. A method of rounding oval rubing in accordance with claim 1, further comprising:

swaging down the outside diameter of the rounded end of the tubing to form a fixture receiving end of a standard diameter on said tubing.

5. A method of rounding a fixtured receiving end of an aluminum flat-oval tubing of the kind used for fluid cooling applications in which said tubing is divided by integral, transverse webs into separate chambered conduits extending the length of the tubing, said method comprising:

(A) setting a reinforcing collar about the periphery of the flat-oval tubing at a desired transition region at which the flat-oval tubing is to become rounded;

(B) cutting the webs in the fixture receiving end of the tubing longitudinally, cutting each web substantially at its midpoint, said cutting step comprising:

(1) registering pilots protruding from a transverse cutting edge of a chisel knife tool into the chambered conduits at the fixture receiving end of the flat-oval tubing;

(2) advancing the cutting edge of the chisel knife tool into the fixture receiving end of the tubing until the cutting edge reaches the desired transition region, thereby severing the webs to the transition region; and (3) withdrawing the chisel knife tool from the fixture receiving end of the flat-oval tubing after it has been advanced to form a cut line of web separation substantially adjacent to the transition point;

(C) reforming the webs at the cut line of web separation to a full radius curve, said reforming steps comprising:

(1) inserting an end forming blade tool into the fixture receiving end of the flat-oval tubing;

(2) forming the webs at the line of web separation by contact with the end forming blade tool; and (3) withdrawing the end forming blade tool from the fitting end of the tubing;

(D) belling out the fixture receiving end of the tubing to a cylindrical shape, said belling out comprising:

(1) registering perpherial grooves in a male arbor with the several webs presented at the fixture receiving end of the flat-oval tubing;

(2) inserting the registered male arbor into the fixture receiving end of the flat-oval tubing causing the inner diameter to take on the shape of the male arbor; and (3) withdrawing the male arbor after it has been inserted substantially as far as the desired transition region; and (E) swaging the outer periphery of the fixture receiving end of the tubing, said swaging operation comprising:

(1) advancing the reducing mandrel over the outer periphery of the fixture receiving end of the tubing;

(2) removing the mandrel from engagement with the flat-oval tubing; and (3) repeating the foregoing swaging steps with progressively smaller mandrels until the outside diameter of the fixture receiving end of the flat-oval tubing is reduced to the desired diameter.

6. A method of rounding a fixture receiving end of an aluminum flat-oval tubing of the kind used for heat transfer applications in which said tubing is divided by integral, transverse webs into separate chambered conduits extending the length of the tubing, said method comprising:

(A) severing the webs in the fixture receiving end of the tubing longitudinally, severing each web substantially at its midpoint, to a depth that places a point of web separation within a desired transition region, thereby producing severed webs;

(B) reforming the webs at the point of web separation to a curve;

(C) registering peripheral grooves in a male arbor having a circular cross-section with the severed webs present at the fixture receiving end of the oval tubing;

(D) driving the male arbor into the fixture receiving end of the tubing after registration, causing an inner wall of the tubing to conform to an outer surface of the male arbor up to the transition region, thereby forming a rounded end on said tubing;

(E) withdrawing the male arbor; and (F) swaging an outer periphery of the fixture receiving end of the tubing with a mandrel to reduce the outside diameter of the rounded end to a standard diameter.

7. A method of rounding a fixtured receiving end of an aluminum flat-oval tubing of the kind used for fluid cooling applications in which said tubing is divided by integral, transverse webs into separate chambered conduits extending the length of the tubing, said method comprising;

(A) cutting the webs in the fixture receiving end of the tubing longitudinally, cutting each web substantially at its midpoint, said cutting step comprising;

(1) registering at least one pilot protruding from a transverse cutting edge of a chisel knife tool into at least one of the chambered conduits at the fixture receiving end of the flat-oval tubing;

(2) advancing the cutting edge of the chisel knife tool into the fixture receiving end of the tubing until the cutting edge reaches a desired transition region, thereby severing the webs to the transition region; and (3) withdrawing the chisel knife tool from the fixture receiving end of the flat-oval tubing after it has been advanced to form a cut line of web separation substantially adjacent to the transition point;

(B) reforming the webs at the cut line of web separation to a curve, said reforming steps comprising:

(1) inserting an end forming blade tool into the fixture receiving end of the flat-oval tubing;

(2) forming the webs at the line of web separation by contact with the end forming blade tool; and (3) withdrawing the end forming blade tool from the fitting end of the tubing;

(C) belling out the fixture receiving end of the tubing to a substantially cylindrical shape, said belling out comprising:

(1) registering peripheral grooves in a male arbor with the severed webs presented at the fixture receiving end of the flat-oval tubing;

(2) inserting the registered male arbor into the fixture receiving end of the flat-oval tubing, causing the inner diameter to take on the shape of the male arbor; and (3) withdrawing the male arbor after it has been inserted substantially as far as the desired transition region; and (D) swaging the outer periphery of the fixture receiving end of the tubing, said swaging operation comprising:

(1) advancing the reducing mandrel over the outer periphery of the fixture receiving end of the tubing;

(2) removing the mandrel from engagement with the flat-oval tubing; and (3) repeating the foregoing swaging steps with progressively smaller mandrels until the outside diameter of the fixture receiving end of the flat-oval tubing is reduced to the desired diameter.

* * * * *